US005134862A

United States Patent [19]

Giehl

[11] Patent Number: 5,134,862

[45] Date of Patent: Aug. 4, 1992

[54] JEWELRY DEVICE WITH LOCKED CHAIN

[76] Inventor: Frank E. Giehl, 8 Tipton La., Willingboro, N.J. 08046

[21] Appl. No.: 704,387

[22] Filed: May 23, 1991

[51] Int. Cl.[5] ..... A44C 25/00

[52] U.S. Cl. ..... 63/23; 63/2; 70/49; 70/53

[58] Field of Search ..... 63/2, 3, 4, 21, 23; 70/346, 49, 31, 38 C, 53

[56] References Cited

U.S. PATENT DOCUMENTS

| | | | |
|---|---|---|---|
| 552,340 | 12/1895 | Tyack | 70/53 |
| 618,561 | 1/1899 | Crandall | 63/21 |
| 648,098 | 4/1900 | Birum | 70/53 |
| 943,031 | 12/1909 | Mendel | 63/2 |
| 1,844,569 | 2/1932 | Fairchild | 70/38 C |
| 1,936,138 | 11/1933 | Militello | 70/53 |
| 4,185,478 | 1/1980 | Stintzi | 70/346 |
| 4,236,384 | 12/1980 | Daub | 63/7 |
| 4,951,484 | 8/1990 | Rohald | 70/346 |

FOREIGN PATENT DOCUMENTS

| | | | |
|---|---|---|---|
| 491921 | 9/1918 | France | 70/38 C |
| 2504813 | 11/1982 | France | 63/23 |
| 2036538 | 7/1980 | United Kingdom | 63/23 |

*Primary Examiner*—Renee S. Luebke
*Assistant Examiner*—F. Saether
*Attorney, Agent, or Firm*—Thomas A. Lennox

[57] ABSTRACT

A piece of jewelry having a body with chain engaging means for releasably engaging at least one end of a chain, and a lock for locking the end of the chain in the chain engaging means and for receiving a separate key to unlock the chain engaging means, to permit removal of the end of the chain.

4 Claims, 1 Drawing Sheet

JEWELRY DEVICE WITH LOCKED CHAIN

FIELD OF THE INVENTION

The invention relates to jewelry carried on a person's body by a chain.

BACKGROUND OF THE INVENTION

Pieces of jewelry carried by chains typically have a clasp to permit connecting or disconnecting the ends of the chain when putting the jewelry on or taking it off.

SUMMARY OF THE INVENTION

It has been discovered that a chain-carried jewelry item can be desirably provided with a lock so that the end of the chain cannot be disconnected, to permit easy removal of the jewelry, unless a separate key is used.

In preferred embodiments the jewelry item is heart shaped, and the chain is sized to prevent removal of the jewelry item from a person's body unless the key is used or the heart shaped jewelry item is broken; the end of the chain is engaged by a spring biased hook provided on the body of the jewelry item, and the hook has a free end that extends from the body when unlocked to permit placing a chain ring in the space between the end of the hook and its other end, and the free end of the hook is within the body when locked to prevent removal of the chain ring from the hook space; the lock has a spring biased plunger with an end that is engaged by a ramp and a slot on the spring biased hook, so that when the hook is inserted, the end of the plunger is biased by the ramp and is then pushed into the slot by its spring to lock the hook in place, and the jewelry body has a hole for providing access to the plunger by the key; the key is provided with a chain and a clasp so that it can be worn by another person; and the piece of jewelry and the key each have inscriptions to identify the persons wearing them.

DESCRIPTION OF THE PREFERRED EMBODIMENT

The structure and operation of the presently preferred embodiment of the invention will now be described after first briefly describing the drawings.

DRAWINGS

STRUCTURE

Figure 1:
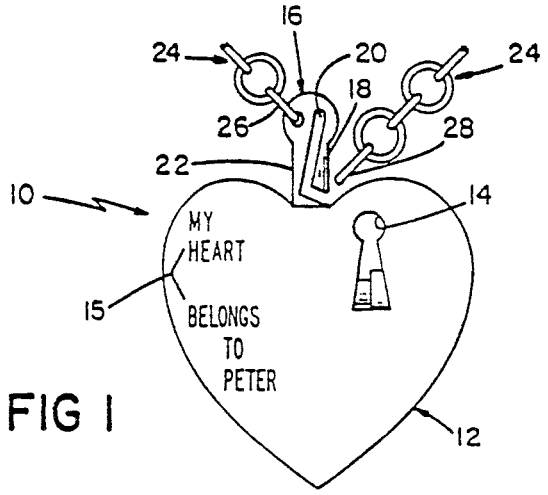
FIG. 1 is a plan view of a chain-carried jewelry item according to the invention.

There is shown in FIG. 1, jewelry item 10 having heart shaped body 12, key hole 14 in body 12, inscription 15 engraved on the surface of body 12, and spring biased hook 16, extending from body 12. Hook 16 has free end 18 and hook space 20 between free end 18 and portion 22, connecting the free end of the hook to its shaft portion slidably mounted in body 12. Chain 24 has end 26 permanently attached to hook 16 and free end 28 with an end chain ring that can be placed in space 20.

Figure 2:
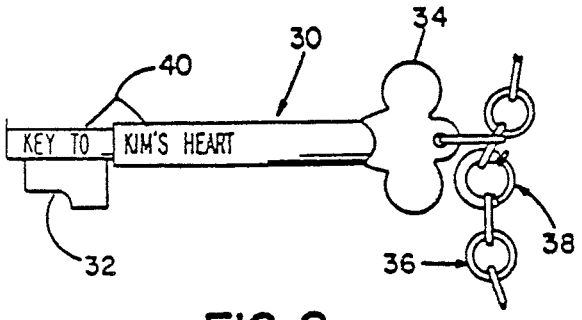
FIG. 2 is an elevation of a chain-carried key for engaging the FIG. 1 jewelry item.

Referring to FIG. 2, there is shown key 30 with end 32 for inserting in key hole 14 and flat end 34 connected to chain 36 having clasp 38. Key 30 has inscription 40 on it identifying the person who will wear jewelry item 10, and inscription 15 similarly identifies the wearer of key 30.

Figure 3:
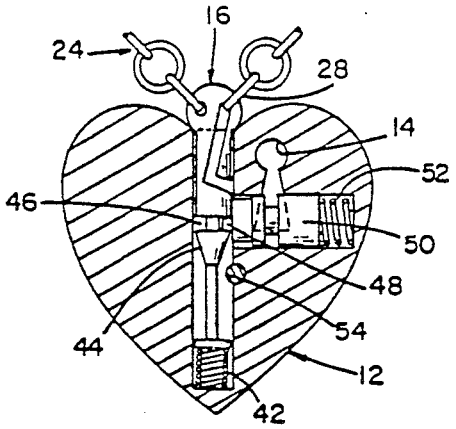
FIG. 3 is a horizontal sectional view of the FIG. 1 jewelry item.

Referring to FIG. 3, jewelry item 10 is shown with hook 16 inserted into a locked position with end 28 of chain 24 locked within hook space 20. It is seen that hook 16 is biased outwardly by spring 42 and has inclined ramp portion 4 and slot 46, that is engaged by end 48 of plunger 50, which is biased by spring 52. Stop 54 prevents hook 16 from being completely removed from body 12.

OPERATION

In operation chain 24 is placed around the wearer's neck, and end 28 is placed in space 20 and locked to heart shaped body 12 by inserting hook 16. As hook 16 is depressed, spring biased plunger 50 is biased to the right by ramp portion 44. When slot 46 is even with plunger end 48, end 48 is biased by spring 52 into it, thereby locking hook 16 in place and preventing removal of end 28 of chain 24. Because chain 24 is sized to prevent removal from the wearer's neck when in a locked position, the only way to remove jewelry item 12 is to break heart shaped body 12 or use key 30. Key 30 is used to unlock jewelry item 10 by inserting end 32 into hole 16 and rotating it to displace plunger 50 to the right, thereby removing end 48 from slot 46 and causing spring 42 to push hook 16 outwardly to the position shown in FIG. 1.

OTHER EMBODIMENTS

Other embodiments of the invention within the scope of the following claims will become apparent to persons skilled in the art.

What is claimed is:

1. A jewelry item comprising:

(a) a jewelry chain that is long enough to fit around a bodily member of a person when its first and second ends are connected, and (b) a piece of jewelry having a body comprising chain engaging means to releasably engage the first end of the chain, and a lock for locking the first end of said chain in said chain engaging means and for receiving a separate key to unlock said chain engaging means, wherein the body comprises an opening and the chain engaging means comprises:

(i) a spring biased member having a first end engaged into the opening and a second end extending out of the body, (ii) chain attachment means to attach a second end of the chain to the second end of the member, and (iii) a hook as an integral part of the second end of the member wherein the hook has a free end that extends out of said opening when unlocked to permit placing a chain ring on the first end of the chain in a space between the free end and the other end of the hook, and the hook moves within said body when locked to prevent removal of said chain ring from said space.

2. The item of claim 1 wherein said member has a ramp and a slot on a hook portion inside said body, and said lock has a spring biased plunger with an end that is engaged by said ramp and said slot on said spring biased member, so that when said member is inserted, said end of said plunger is biased by said ramp and then is pushed into said slot by its spring to lock said member in place, and said body has a hole providing access to said plunger by said key to move said end of said plunger out of said slot.

3. The item of claim 1 or 2 wherein said body is heart shaped, and said chain is sized to prevent removal of said jewelry item from a person's body unless said key is used, or said heart-shaped body is broken.

4. The item of claim 1 wherein said jewelry piece and said key have inscriptions identifying the persons to wear them.

* * * * *